US008361257B2

(12) United States Patent
Schroder

(10) Patent No.: US 8,361,257 B2
(45) Date of Patent: Jan. 29, 2013

(54) LAMINATED ENERGETIC DEVICE

(75) Inventor: Kurt A. Schroder, Coupland, TX (US)

(73) Assignee: NCC Nano, LLC, Dallas, TX (US)

( * ) Notice: Subject to any disclaimer, the term of this patent is extended or adjusted under 35 U.S.C. 154(b) by 0 days.

(21) Appl. No.: 13/439,943

(22) Filed: Apr. 5, 2012

(65) Prior Publication Data

US 2012/0186708 A1 Jul. 26, 2012

Related U.S. Application Data

(62) Division of application No. 12/252,462, filed on Oct. 16, 2008, now Pat. No. 8,172,963.

(51) Int. Cl.

| | |
|---|---|
| ***C06B 45/00*** | (2006.01) |
| ***C06B 45/18*** | (2006.01) |
| ***C06B 47/08*** | (2006.01) |
| ***C06B 27/00*** | (2006.01) |
| ***D03D 23/00*** | (2006.01) |
| ***D03D 43/00*** | (2006.01) |

(52) U.S. Cl. ..... 149/3; 149/2; 149/37; 149/87; 149/109.4

(58) Field of Classification Search ..... 149/3, 2, 149/37, 87, 109.4
See application file for complete search history.

(56) References Cited

U.S. PATENT DOCUMENTS

| | | | | |
|---|---|---|---|---|
| 5,997,667 | A * | 12/1999 | Jacobson | 149/37 |
| 6,863,992 | B2 * | 3/2005 | Weihs et al. | 428/607 |
| 8,172,963 | B2 * | 5/2012 | Schroder | 149/3 |
| 2010/0096049 | A1 * | 4/2010 | Schroder | 149/3 |

* cited by examiner

*Primary Examiner* — James McDonough
(74) *Attorney, Agent, or Firm* — Antony P. Ng; Yudell Isidore Ng Russell PLLC

(57) ABSTRACT

A laminated energetic device is disclosed. The laminated energetic device includes a low-gas generating energetic mixture, a core on which the low-gas generating energetic mixture is located, and a protective film for sealing the low-gas generating energetic mixture between the core and the protective film.

6 Claims, 1 Drawing Sheet

LAMINATED ENERGETIC DEVICE

PRIORITY CLAIM

The present application is a divisional of U.S. patent application Ser. No. 12/252,462, filed on Oct. 16, 2008 now U.S. Pat. No. 8,172,963. Applicant claims benefit of priority under 35 U.S.C. §120 to U.S. patent application Ser. No. 12/252,462, which is incorporated by reference herein in its entirely and for all purposes.

BACKGROUND OF THE INVENTION

1. Technical Field

The present invention relates to energetic devices in general, and, in particular, to energetic devices for pyrotechnics. Still more particularly, the present invention relates to a laminated energetic device having a high propagation speed and low gas generation.

2. Description of Related Art

Energetic devices for pyrotechnics are well-known in the art. An energetic device includes an energetic composition, and the energetic composition may be high-gas generating or low-gas generating. An example of a low-gas generating energetic composition is an intermetallic or a thermite. The most common thermite is a mixture of aluminum powder and iron powder. Once ignited, the thermite composition reacts exothermically, which raises the temperature of the mixture to approximately 3,000° C., resulting in molten iron and aluminum oxide while producing little or no permanent gas. The heat from the reaction can be used for many applications such as cutting and welding torches, plating of metals upon substrates, cutting or plugging oil well conduits, etc.

For many of the above-mentioned applications, it is desirable to maximize the transfer of heat from the thermite reaction to a target. However, for other applications, it may be desirable to use a low heat, fast-burning thermite composition.

SUMMARY OF THE INVENTION

In accordance with a preferred embodiment of the present invention, an energetic device includes a low-gas generating energetic mixture, a core on which the low-gas generating energetic mixture is located, and a protective film for sealing the low-gas generating energetic mixture between the core and the protective film.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
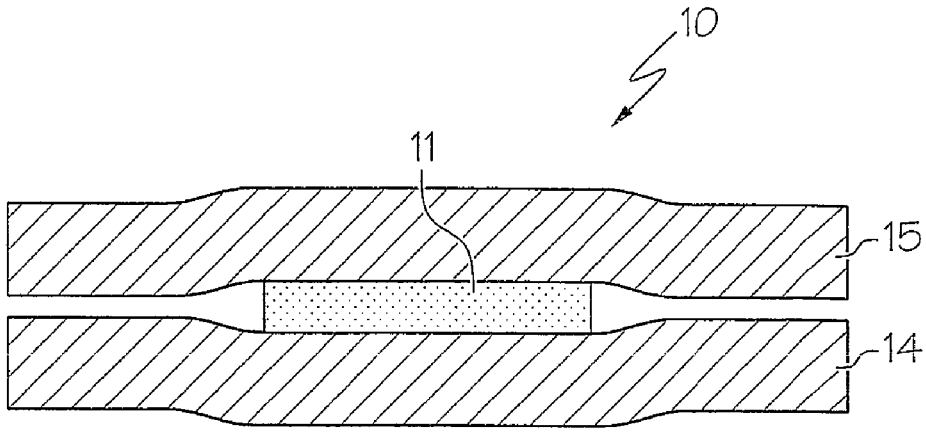
FIG. 1 is a diagram of a laminated energetic device in a flat structure, in accordance with a preferred embodiment of the present invention.

Referring now to the drawings and in particular to FIG. 1, there is depicted a diagram of a laminated energetic device in a flat structure, in accordance with a preferred embodiment of present invention. As shown, a laminated energetic device 10 includes a low-gas generating energetic mixture 11 embedded between a first film 14 and a second film 15. Low-gas generating energetic mixture 11 can be a thermite or an intermetallic. Examples of low-gas generating thermites include $2Al/Fe_2O_3$, $4Al/3SiO_2$, $4Al/3TiO_2$, $2Al/3CuO$, $2Mg/SiO_3$, $2Ti/2Fe_2O_3$. Examples of intermetallics include Al/Ni, 2Al/3S, 2B/Mo, 2Mg/Si, 3Si/5Ti. First and second films 14, 15 can be made of, for example, polyethylene terephthalate (PET) films, plastic films, polymer films or metal foils. Low-gas generating energetic mixture 11 is hermetically sealed within first and second films 14, 15.

If a thermite is being used, low-gas generating energetic mixture 11 preferably includes a stoichiometric mixture of ferrous oxide ($Fe_3O_4$) and aluminum. Aluminum can be 80 nm aluminum power available commercially from Novacentrix Corporation. Iron oxide power can be 25 nm average diameter available commercially from Novacentrix Corporation. Low-gas generating energetic mixture 11 can be dispersed in isopropanol and sonicated.

Initially, a layer of dispersed low-gas generating energetic mixture 11 can be "painted" onto first film 14 as a trace having a width of approximately 2 cm and a thickness of approximately 0.01" or less. After the trace was allowed to dry, second film 15 is placed over first film 14 to form an air-tight and water-tight laminated structure for enclosing low-gas generating energetic mixture 11.

Alternatively, the energetic mixture can be deposited in multiple alternating layers of metal comprising an intermetallic pair using magnettron sputtering.

Low-gas generating energetic mixture 11 can be ignited with an ordinary lighter at one of the two ends of laminated energetic device 10. The propagation speed through low-gas generating energetic mixture 11 is approximately 4 m/s. Because the reaction propagation is very fast, first and second films 14, 15 do not catch on fire from the reaction. In addition, low-gas generating energetic mixture 11 has a very low gas generation during combustion; thus, laminated energetic device 10 remains sealed during and after the combustion of low-gas generating energetic mixture 11. Since the total amount of energy per unit length of laminated energetic device 10 is relatively low, the temperature of laminated energetic device 10 immediately after the combustion of low-gas generating energetic mixture 11 is low enough that it can be safely held in the hand First and second films 14, 15 need not be transparent. However, if first and second films 14, 15 are transparent, they can be initiated photonically, e.g., with an intense light source such as a xenon strobe or a laser, through the sealed films 14, 15, and the integrity of first and second films 14, 15 need not to be breached in order to ignite low-gas generating energetic mixture 11.

Figure 2:
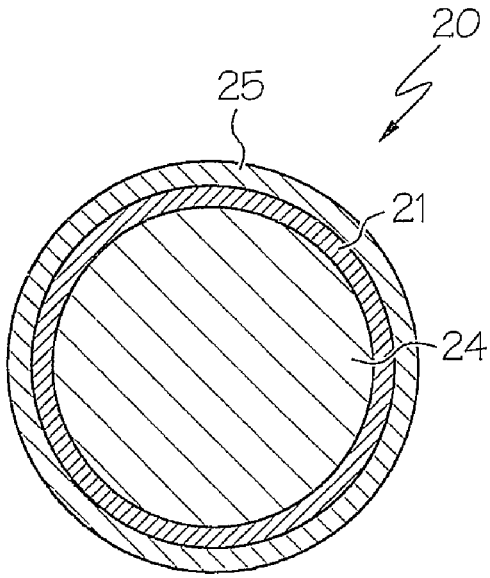
FIG. 2 is a diagram of a laminated energetic device in an annulus structure, in accordance with a preferred embodiment of the present invention.

Instead of a flat structure, as shown in FIG. 1, an annulus structure can also be used for containing a thermite mixture. With reference now to FIG. 2, there is depicted a diagram of a laminated energetic device in an annulus structure, in accordance with a preferred embodiment of present invention. As shown, a laminated energetic device 20 includes a low-gas generating energetic mixture 21 embedded between a cylindrical core 24 and a protecting coating 25. Low-gas generating energetic mixture 21 is hermetically sealed between cylindrical core 24 and protecting coating 25.

Low-gas generating energetic mixture 21 is initially applied on the surface of cylindrical core 24 such as a tube or a solid rod. Protective coating 25 is then applied over low-gas generating energetic mixture 21 and cylindrical core 24. This method can be more economical because both low-gas generating energetic mixture 21 and protective coating 25 can be serially applied with a continuous dip of a cylindrical core though different liquids.

The propagation speed of low-gas generating energetic mixture 21 on cylindrical core 24 is likely to be much faster than a thermite mixture on a flat structure (such as low-gas generating energetic mixture 11 on first film 14 in FIG. 1) for the same film properties if cylindrical core 24 is optically transparent. This is because fully half of the radiation is directed inward to low-gas generating energetic mixture 21. Furthermore, the annulus geometry enables radiation to be transmitted upstream of the flame front to preheat the unburned low-gas generating energetic mixture 21, which reduces the activation energy and increases the burn rate.

As has been described, the present invention provides a laminated energetic device having a high propagation speed and a low gas generation.

While the invention has been particularly shown and described with reference to a preferred embodiment, it will be understood by those skilled in the art that various changes in form and detail may be made therein without departing from the spirit and scope of the invention.

What is claimed is:

1. An energetic device comprising:

a low-gas generating energetic mixture;

a core on which said low-gas generating energetic mixture is located, wherein said core is tubular; and a protective film for sealing said low-gas generating energetic mixture between said core and protective film.

2. An energetic device comprising:

a low-gas generating energetic mixture;

a core on which said low-gas generating energetic mixture is located; and a protective film for sealing said low-gas generating energetic mixture between said core and protective film, wherein said core and protective film are hermetically sealed.

3. The energetic device of claim 1, wherein said low-gas generating energetic mixture is a thermite.

4. The energetic device of claim 1, wherein said low-gas generating energetic mixture is an intermetallic.

5. The energetic device of claim 1, wherein said low-gas generating energetic mixture is approximately 0.01" thick or less.

6. An energetic device of comprising:

a low-gas generating energetic mixture;

a core on which said low-gas generating energetic mixture is located, wherein said core is cylindrical; and a protective film for sealing said low-gas generating energetic mixture between said core and protective film.

* * * * *